US008387558B2

(12) United States Patent
Herre et al.

(10) Patent No.: US 8,387,558 B2
(45) Date of Patent: Mar. 5, 2013

(54) PISTON ROD SEAL FOR AN INSULATING CYLINDER OF A COATING PLANT

(75) Inventors: Frank Herre, Oberriexingen (DE); Rainer Melcher, Oberstenfeld (DE); Manfred Michelfelder, Steinheim (DE)

(73) Assignee: Dürr Systems GmbH (DE)

( * ) Notice: Subject to any disclaimer, the term of this patent is extended or adjusted under 35 U.S.C. 154(b) by 471 days.

(21) Appl. No.: 12/601,379

(22) PCT Filed: May 9, 2008

(86) PCT No.: PCT/EP2008/003771

§ 371 (c)(1),
(2), (4) Date: Nov. 23, 2009

(87) PCT Pub. No.: WO2008/141742

PCT Pub. Date: Nov. 27, 2008

(65) Prior Publication Data

US 2010/0163638 A1 Jul. 1, 2010

(30) Foreign Application Priority Data

May 23, 2007 (DE) ..... 10 2007 023 931

(51) Int. Cl.

| | |
|---|---|
| ***B05B 5/025*** | (2006.01) |
| ***B05B 15/02*** | (2006.01) |
| ***B05B 1/28*** | (2006.01) |
| ***B05C 11/00*** | (2006.01) |

(52) U.S. Cl. ..... 118/621; 118/635; 118/302; 118/712; 239/691; 239/104; 239/123

(58) Field of Classification Search ..... 118/620–640, 118/302, 712; 277/437–439; 239/3, 71, 239/708, 691, 104, 123, 120; 141/91, 98
See application file for complete search history.

(56) References Cited

U.S. PATENT DOCUMENTS

| | | | | |
|---|---|---|---|---|
| 3,673,855 | A * | 7/1972 | Garday et al. | 73/40 |
| 4,126,321 | A | 11/1978 | Harjar et al. | |
| 4,266,468 | A | 5/1981 | Biggs | |
| 4,469,251 | A | 9/1984 | Sperry et al. | |
| 4,863,101 | A | 9/1989 | Pater et al. | |
| 5,096,126 | A * | 3/1992 | Giroux et al. | 239/690 |
| 5,319,568 | A * | 6/1994 | Bezaire | 700/123 |

(Continued)

FOREIGN PATENT DOCUMENTS

| | | |
|---|---|---|
| DE | 69203299 T2 | 2/1992 |
| DE | 69228249 | 9/1992 |

(Continued)

OTHER PUBLICATIONS

International Search Report dated Apr. 12, 2008 for PCT/EP2008/003771.

*Primary Examiner* — Yewebdar Tadesse
(74) *Attorney, Agent, or Firm* — Bejin, VanOphem & Bieneman PLC

(57) ABSTRACT

Various exemplary illustrations of a piston rod seal are disclosed. An exemplary piston rod seal may include a piston rod guide for guiding a piston rod that supports a scraping piston configured to scrape paint residue from an inner wall of a pipeline cylinder. The piston rod may further include a first seal for sealing the piston rod guide relative to the piston rod, and a second seal for sealing the piston rod guide relative to the piston rod, where the second seal is arranged axially offset relative to the first seal.

27 Claims, 2 Drawing Sheets

U.S. PATENT DOCUMENTS

| | | | | |
|---|---|---|---|---|
| 5,364,035 | A | 11/1994 | Ma et al. | |
| 5,458,927 | A | 10/1995 | Malaczynski et al. | |
| 5,562,406 | A | 10/1996 | Ooka et al. | |
| 5,647,542 | A * | 7/1997 | Diana | 239/690 |
| 5,964,408 | A | 10/1999 | Musson | |
| 6,139,023 | A * | 10/2000 | Heine et al. | 277/551 |
| 2004/0112695 | A1 * | 6/2004 | Niwa et al. | 188/322.17 |

FOREIGN PATENT DOCUMENTS

| | | | |
|---|---|---|---|
| DE | 19524853 | A1 | 1/1996 |
| DE | 19611003 | A1 | 9/1996 |
| DE | 19756488 | A1 | 7/1999 |
| DE | 102005048223 | A1 | 4/2007 |
| DE | 102005060959 | A1 | 4/2007 |
| EP | 0525164 | A1 | 2/1993 |
| FR | 2675402 | A1 | 10/1992 |
| GB | 775232 | A | 5/1957 |
| GB | 2256679 | A | 12/1992 |
| GB | 2319737 | A | 6/1998 |

* cited by examiner

PISTON ROD SEAL FOR AN INSULATING CYLINDER OF A COATING PLANT

CROSS-REFERENCE TO RELATED APPLICATIONS

This application is a National Phase application claiming the benefit of International Application No. PCT/EP2008/003771, filed May 9, 2008, which claims priority to German Patent Application No. DE 10 2007 023 931.0, filed May 23, 2007, the complete disclosures of which are hereby incorporated in by reference in their entireties.

FIELD

The present disclosure relates to a piston rod seal for an insulating cylinder of an electrostatic coating system and a corresponding operating method according to the subsidiary claims.

BACKGROUND

DE 10 2005 048 223 A1 discloses a paint coating system wherein a paint reservoir is connected, via an insulating cylinder, to a paint dosing device arranged upstream, wherein the paint dosing device doses the paint to be applied in controlled manner and feeds the paint to a rotary atomizer or other application equipment. The insulating cylinder enables electrical insulation of the paint dosing device in relation to the paint reservoir. This is advantageous since, with an electrostatic paint application method, the paint dosing device is usually at a high potential, whilst the paint reservoir, which is electrically insulated from the paint dosing device, is at earth potential and can therefore be refilled during the coating process. For electrical insulation, the paint residues located in the insulating cylinder are removed from the inner wall of the insulating cylinder by a scraping piston, in order to create the requisite electric strength. The scraping piston is mounted on one end of a piston rod which is displaceably mounted in a piston rod guide and supports a pneumatic piston at the other end thereof, which can be pneumatically driven in a pneumatic cylinder in order to displace the scraping piston in the insulating cylinder.

A problem with this known insulating cylinder is the fact that, in the region between the scraping piston and the piston rod guide, the piston rod is exposed to the paint to be applied, so that the paint adhering to the outer surface of the piston rod is able to penetrate through the piston rod guide into the pneumatic cylinder where the paint can then stick to and, in the worst case, block the pneumatic cylinder. In practice, the result is initially a slowing-down of the movement speed of the pneumatic cylinder and thus leads to cycle time problems. Eventually, the pneumatic cylinder can become entirely blocked, leading to cessation of production in the paint shop. A particular danger herein results from relatively long stoppage times (e.g. at night or over a weekend), when components become stuck due to hardening paint residues and then fail when production is restarted.

A further problem with the above-described known insulating cylinder is the unsatisfactory service life of the piston rod seal during 'dry operation' of the piston rod, during which small quantities of paint can dry on the piston rod, and this leads to increased abrasiveness and to premature failure of the piston rod seal.

With regard to the prior art, reference is also made to U.S. Pat. No. 4,863,101 A, DE 692 03 299 T2, U.S. Pat. No. 5,964,408 A, U.S. Pat. No. 4,469,251 A, U.S. Pat. No. 4,266, 468 A, U.S. Pat. No. 4,126,321 A, DE 10 2005 060 959 A1, DE 692 28 249 T2, DE 195 24 853 C2 and U.S. Pat. No. 5,458,927 A. However, none of these citations describes a coating material supply device with an insulating cylinder comprising a piston rod seal which ensures satisfactory leak prevention.

Accordingly, there is a need for an improved insulating cylinder.

BRIEF DESCRIPTION OF THE DRAWINGS

Various advantageous aspects of the present disclosure are explained in greater detail below together with the description of the exemplary illustrations, making reference to the drawings, in which.

DETAILED DESCRIPTION

Figure 1:
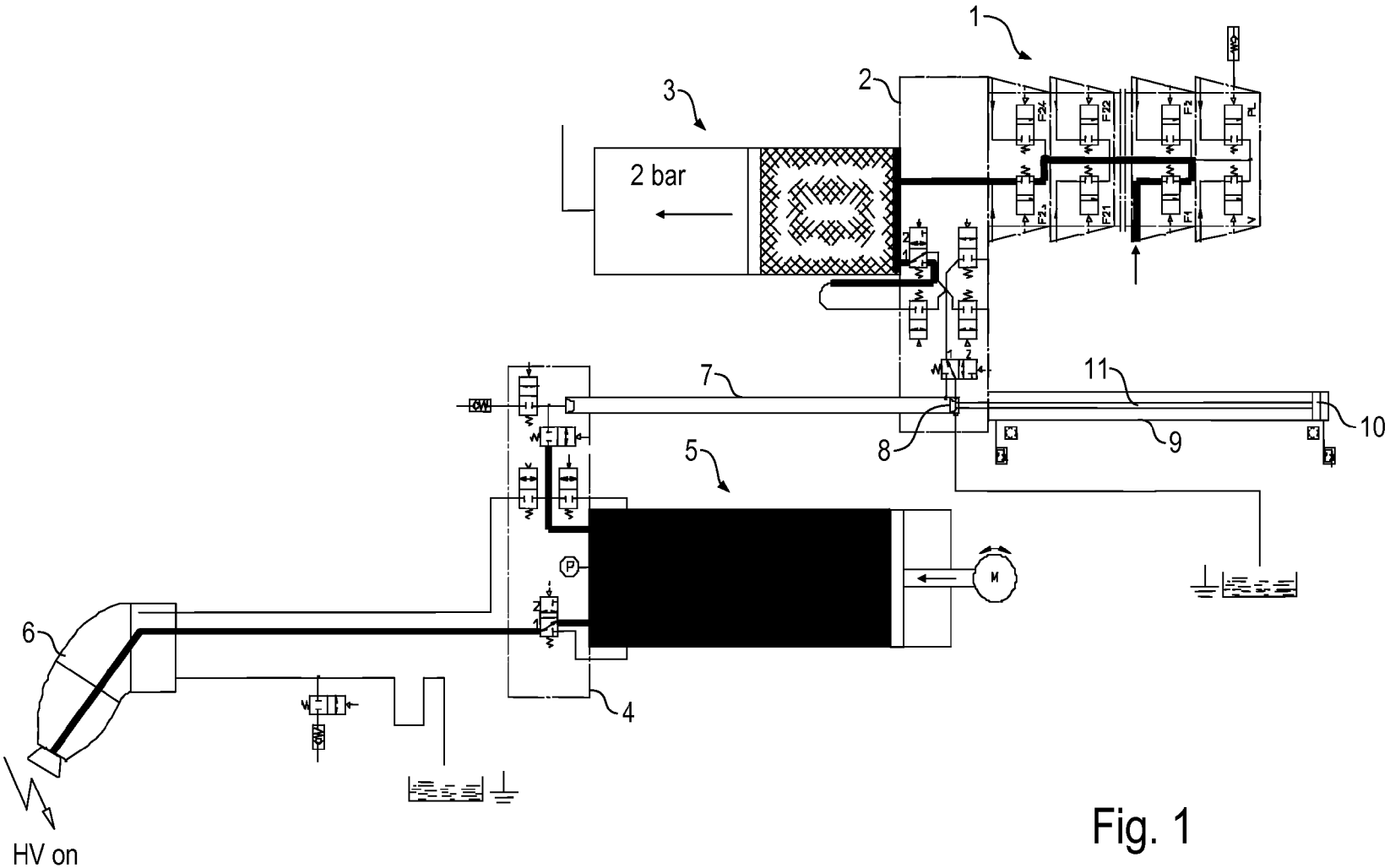
FIG. 1 shows an electrostatic paint coating system according to an exemplary illustration with an insulating cylinder for electrical insulation of a paint reservoir relative to a paint dosing device arranged downstream after the paint reservoir.

According to various exemplary illustrations, a piston rod seal is described herein that does not have only a single seal, but rather includes at least two seals that are offset in an axial direction.

The additional seal(s) provides additional reliability, since the sealing function is not impaired even if one seal fails.

At the same time, the exemplary arrangement of a plurality of spatially separate seals enables fault monitoring in that the intermediate space between the two seals is monitored for leakage.

A leakage chamber may thus be arranged in an axial direction, e.g., relative to an axis of the piston rod, between the two seals, wherein the leakage chamber is situated in a radial direction between the piston rod guide and the outer surface of the piston rod and, in the event of a leak, the paint-side seal takes up any leaked paint which finds its way through.

In one exemplary illustration, a leakage bore extends away from the leakage chamber in order to conduct away the leakage occurring in the leakage chamber.

The leakage bore can also be used to recognize or detect a leak. For this purpose, the leakage bore can lead to or be in fluid communication with, for example, a sensor, e.g., a pressure sensor or a humidity sensor. If the leakage sensor detects a leak, the piston rod seal can be serviced or changed at the next opportunity, which could be during regular operational interruptions for service, e.g., at night or during the weekend, so that regular painting operation is not impaired by a leak in the piston rod seal.

A mechanical drive of the piston rod and/or the scraping piston may be carried out pneumatically, e.g., as provided in DE 10 2005 048 223 A1, which is hereby incorporated by reference herein in its entirety. For example, the piston rod may carry a pneumatic piston on the side opposing the scraping piston, such that said piston is displaceably arranged in a pneumatic cylinder and can have pressure applied to it in order to displace the pneumatic piston, and thus also the piston rod and the scraping piston, in the axial direction. In this type of drive of the piston rod by a pneumatic cylinder, an exemplary piston rod seal may advantageously have another seal which is arranged axially offset relative to the two aforementioned redundant seals and has the purpose of sealing relative to the pneumatic cylinder.

In another exemplary illustration, a piston rod seal may comprise three seals, specifically two wet paint seals on the side of the scraping piston or on the side of the insulating cylinder, and at least one pneumatic seal on the side of the pneumatic cylinder.

Any one or more of the exemplary seals may include a plurality of sealing edges, thereby increasing the service life of the seals. For example, the wet paint seals may each have double sealing edges.

The wet paint seals may be formed of a thermoplastic sealing material, for example, polytetrafluoroethylene (PTFE) or polyethylene (PE). However, the exemplary seals may be formed from other sealing materials.

The seals can herein optionally be supported by a metal spring in order to improve a sealing effect thereof.

The piston rod may also advantageously have a low surface roughness on its outer surface, e.g., a roughness value of Rz<20 μm, Rz<10 μm, Rz<5 μm or even Rz<2 μm. In the first place, it is advantageous if a smooth sealing surface of the piston rod makes it more difficult for paint to be transferred in the axial direction through the piston rod guide. In the second place, the service life of the piston rod seal is increased by a low surface roughness.

In order to avoid paint transfer in the axial direction, it is also advantageous if the piston rod comprises a percentage contact area at the sealing surface thereof of more than 60%, 70% or even more than 80%.

This can advantageously be achieved in that the piston rod comprises, at the sealing surface thereof, a wear-reducing surface coating which can comprise, for example, Dylyn® or DLC™ (DLC: Diamond-like Carbon).

The application of this surface coating can be carried out, for example, by means of a plasma-supported chemical vapour-deposition method (PACVD: Plasma Assisted Chemical Vapour Deposition) or with a physical vapour-deposition method (PVD: Physical Vapour Deposition).

The exemplary illustrations may be not only directed to a novel piston rod seal as a single component, but also to a coating supply device and a paint coating system, which have a piston rod seal of this type as a component.

It is also noteworthy that the exemplary illustrations are not limited to piston rod guides for insulating cylinders in electrostatic coating systems. Rather, the exemplary illustrations are suitable in general for piston rod guides for guiding piston rods in pipeline cylinders.

Finally, the exemplary illustrations also relate to a novel operating method for a piston rod seal of this type wherein the insulating atomizer is rinsed between the scraping piston and the piston rod seal with a rinsing agent or a coating material in order to prevent coating material residues from becoming deposited on the outer surface of the piston rod and then being transferred through the piston rod guide in the axial direction.

This rinsing can be carried out regularly, e.g., periodically, in order to avoid the aforementioned disadvantages in advance.

Turning now to FIG. 1, an electrostatic paint coating system for serial paint coating of vehicle body parts or other components is illustrated, wherein the design and the functioning of this paint coating system is described in detail in the patent application DE 10 2005 048 223 A1 cited above, so that the content of this patent application with regard to the structure and functioning of the paint coating system can be considered to be included in its entirety in this description. DE 10 2005 048 223 A1 is therefore incorporated by reference herein in its entirety.

It therefore remains only to mention that the paint coating system comprises a colour changer 1, a valve arrangement 2, a paint reservoir 3, a further valve arrangement 4, a paint dosing device 5 and a rotary atomizer 6 as the application device.

The paint reservoir 3 and the paint dosing device 5 can be at different electrical potentials during operation of the paint coating system.

During application of the paint, the paint dosing device 5 may be at a high potential in order to achieve optimum adhesion of the applied paint to the electrically earthed vehicle bodywork parts.

By contrast, the paint reservoir 3 may be at a lower electrical potential, e.g., earth potential or grounded, during operation of the paint coating system, so that the paint reservoir 3 can be refilled with new paint during coating.

For the electrical insulation of the paint reservoir 3 relative to the paint dosing device 5, an insulating cylinder 7 may be provided in which a scraping piston 8 is guided to be axially displaceable. For the electrical insulation of the insulating cylinder 7, the scraping piston 8 is moved to the right into the position shown in the drawing, wherein the scraping piston 8 scrapes paint residues from the inner wall of the insulating cylinder 7 and thereby increases the electric strength of the insulating cylinder 7.

The movement of the scraping piston 8 in the insulating cylinder 7 may be brought about by a pneumatic cylinder 9 which is arranged on the side opposing the insulating cylinder 7. For example, a pneumatic piston 10 may be provided that is axially displaceable in the pneumatic cylinder 9, wherein the pneumatic piston 10 is connected via a piston rod 11 to the scraping piston 8. Pressure can be applied to the pneumatic piston 10 via valves from both sides in order to move the pneumatic piston 10, and thus also the piston rod 11 and the scraping piston 8, in the axial direction.

Figure 2:
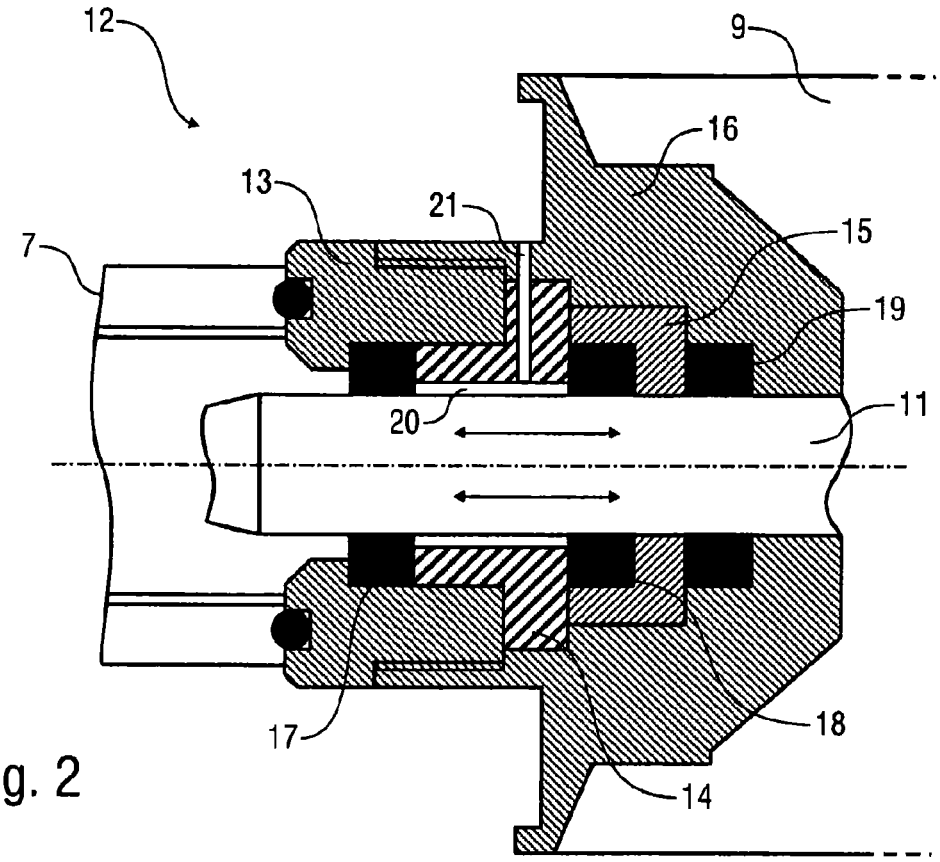
FIG. 2 shows a cross-section of the piston rod guide in an insulating cylinder of FIG. 1

Turning now to FIG. 2, an exemplary piston rod seal 12 is described in further detail.

The piston rod seal 12 may include a plurality of components 13, 14, 15, 16 screwed together which surround the piston rod 11 and accommodate two wet paint seals 17, 18 and a pneumatic seal 19.

The two wet paint seals 17, 18 may be arranged on the side facing the insulating cylinder 7 and prevent paint from the insulating cylinder 7 entering the pneumatic cylinder 9 through the piston rod seal 12 or into the piston rod seal 12.

The pneumatic seal 19, by contrast, may be arranged on the side of the piston rod seal 12 facing toward the pneumatic cylinder 9. Further, the pneumatic seal 19 may be pressure-tight so that a pneumatic operating pressure in the pneumatic cylinder 9 is maintained.

The piston rod seal 12 may also include a leakage chamber 20 which is arranged in the axial direction between the two wet paint seals 17, 18 and in the radial direction between the outer surface of the piston rod 11 and the surrounding component 14.

As shown, a leakage bore 21 may extend from the leakage chamber 20 to the outside to enable connection of a leakage sensor (not shown here for the sake of simplicity). For example, if the wet paint seal 17 leaks, wet paint enters the leakage chamber 20, and this can be detected by the leakage sensor via a leakage bore 21. In this condition, the sealing function can still be maintained with the second wet paint seal 18, so that operation of the paint coating system is not disrupted. The piston rod seal 12 can then be changed during the next regular interruption of operation.

Figure 3:
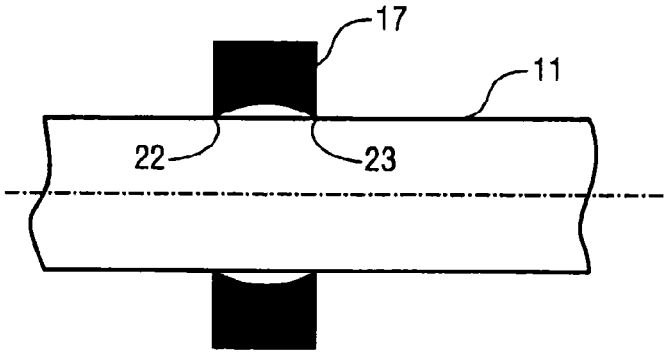
FIG. 3 shows a simplified cross-section of a seal in the piston rod guide of FIG. 2.

FIG. 3 shows an exemplary illustration of a wet paint seal 17 having two sealing edges 22, 23, by which means the service life of the wet paint seal 17 may advantageously be increased.

The invention is not limited to the embodiments described above. Rather, a plurality of variants and modifications are possible, which likewise make use of the concept of the invention and therefore fall under the scope of protection. Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. A piston rod seal for a pipeline cylinder of a coating system, comprising:

a piston rod guide for axially displaceable guidance of a piston rod, wherein the piston rod supports a scraping piston in order to scrape paint residues from the inner wall of the pipeline cylinder, a first seal for sealing the piston rod guide relative to the piston rod, and a second seal for sealing the piston rod guide relative to the piston rod, wherein the second seal is arranged axially offset relative to the first seal.

2. The piston rod seal according to claim 1, wherein the pipeline cylinder is an insulating cylinder and the coating system is an electrostatic coating system.

3. The piston rod seal according to claim 1, further comprising a leakage chamber which is arranged in an axial direction between the first seal and the second seal, the leakage chamber arranged in a radial direction between the piston rod and the piston rod guide, the leakage chamber configured to receive leakage when a leak is present in the first seal.

4. The piston rod seal according to claim 3, further comprising: a leakage bore which extends away from the leakage chamber, the leakage bore configured to conduct the leakage away from the leakage chamber.

5. The piston rod seal according to claim 3, further comprising a leakage sensor configured to detect a leak.

6. The piston rod seal according to claim 5, wherein the leakage sensor is arranged in the leakage chamber.

7. The piston rod seal according to claim 5, wherein the leakage sensor is in fluid communication with the leakage chamber via a leakage bore.

8. The piston rod seal according to claim 1, further comprising a third seal configured to seal the piston rod guide relative to the piston rod, wherein the third seal is axially offset in relation to the first seal and the second seal.

9. The piston rod seal according to claim 1, wherein the piston rod supports the scraping piston on one side, the piston rod supporting a pneumatic piston on another side, the pneumatic piston being displaceably guided in a pneumatic cylinder.

10. The piston rod seal according to claim 9, wherein:

the first seal and the second seal are wet seals and are arranged on the side of the pipeline cylinder, and the third seal is a pneumatic seal and is arranged on the side of the pneumatic cylinder.

11. The piston rod seal according to claim 1, wherein at least one of the first seal, the second seal, and the third seal comprises a plurality of sealing edges which seal relative to the outer surface of the piston rod.

12. The piston rod seal according to claim 1, wherein at least one of the first seal and the second seal are formed of a thermoplastic sealing material.

13. The piston rod seal according to claim 12, wherein the thermoplastic sealing material is selected from a group consisting of polytetrafluoroethylene and polyethylene.

14. The piston rod seal according to claim 1, wherein at least one of the first seal and the second seal comprises a metal spring.

15. The piston rod seal according to claim 1, wherein the piston rod has a surface roughness on the sealing surface thereof, the surface roughness having a roughness value, wherein the roughness value comprises a maximum which is selected from a group consisting of $R_z<20$ μm, $R_z<10$ μm, $R_z<5$ μm and $R_z<2$ μm.

16. The piston rod seal according to claim 1, wherein the piston rod comprises a percentage contact area, at the sealing surface thereof, of more than 60%.

17. The piston rod seal according to claim 1, wherein the piston rod comprises a percentage contact area, at the sealing surface thereof, of more than 70%.

18. The piston rod seal according to claim 1, wherein the piston rod comprises a percentage contact area, at the sealing surface thereof, of more than 80%.

19. The piston rod seal according to claim 1, wherein the piston rod comprises, at the sealing surface thereof a wear-reducing surface coating.

20. The piston rod seal according to claim 19, wherein the surface coating comprises a carbon layer.

21. The piston rod seal according to claim 19, wherein the surface coating is applied with a plasma-supported chemical vapour-deposition method.

22. The piston rod seal according to claim 19, wherein the surface coating is applied with a physical vapour-deposition method.

23. A coating supply device comprising an insulating cylinder for electrical insulation of components at a different electrical potential, further comprising a piston rod seal according to claim 1.

24. A piston rod seal for a pipeline cylinder of a coating system, comprising:

a piston rod guide for axially displaceable guidance of a piston rod, wherein the piston rod supports a scraping piston in order to scrape paint residues from the inner wall of the pipeline cylinder, a first seal for sealing the piston rod guide relative to the piston rod, a second seal for sealing the piston rod guide relative to the piston rod, wherein the second seal is arranged axially offset relative to the first seal, and a chamber disposed in an axial direction between the first seal and the second seal, the chamber disposed in a radial direction between the piston rod and the piston rod guide, the chamber configured to receive leakage when a leak is present in the first seal.

25. The piston rod seal according to claim 24, further comprising a leakage sensor configured to detect a leak, wherein the leakage sensor is arranged in the chamber.

26. The piston rod seal according to claim 25, further comprising: a bore extending away from the chamber, the bore configured to conduct a leakage away from the chamber.

27. The piston rod seal according to claim 26, wherein the leakage sensor is in fluid communication with the chamber via the bore.

* * * * *